United States Patent [19]

Duren

[11] Patent Number: 4,671,076

[45] Date of Patent: Jun. 9, 1987

[54] CONDENSED VAPOR VENT

[76] Inventor: Monica O. Duren, 13231 Portofino Dr., Del Mar, Calif. 92041

[21] Appl. No.: 899,331

[22] Filed: Aug. 22, 1986

[51] Int. Cl.[4] ..... F25D 21/14

[52] U.S. Cl. ..... 62/289; 62/291

[58] Field of Search ..... 62/285, 288, 289, 291

[56] References Cited

U.S. PATENT DOCUMENTS

| | | | |
|---|---|---|---|
| 1,890,085 | 12/1932 | Hill | 62/288 X |
| 2,155,831 | 4/1939 | Hull | 62/285 X |
| 2,175,946 | 10/1939 | Smith | 62/291 X |
| 2,480,346 | 8/1949 | Watts | 62/291 X |
| 2,797,560 | 7/1957 | Kooiker | 62/288 |
| 3,918,271 | 11/1975 | Whisler | 62/285 |

*Primary Examiner*—William E. Tapoicai

*Attorney, Agent, or Firm*—Frank D. Gilliam

[57] ABSTRACT

A condensate vapor and liquid vent for use with an operable air conditioning system in a habitable structure or enclosure which is substantially closed to the atmosphere. Ambient damp air under positive pressure is forced past a conventional refrigerated "A" frame evaporator of reduced temperature. The dampness and contaminants from the air are condensed, concentrated and collected in a pan which surrounds the lower portion of the "A" frame evaporator. A portion of the upper surface of the collection pan is enclosed except for a small opening around the "A" frame condenser and between the "A" frame evaporator and the upper surface of the collection pan. The collection pan has an inclined bottom surface to allow all of the condensate liquid to flow to one corner where a liquid drain removes condensate to the structure sewage system. Intermediate the corner of the collection pan and the conventional "P" trap of the condensate drain system is a vapor vent to atmosphere. This vent due to the positive pressure of the circulating ambient air forces condensate vapor in the collection pan and around the "A" frame evaporator to flow to the atmosphere. A blower motor may be positioned within the vent to continue to remove condensate vapors from the ambient air around the "A" frame condenser and collection pan when the air conditioning system is not in use.

5 Claims, 3 Drawing Figures

CONDENSED VAPOR VENT

BACKGROUND OF THE INVENTION

The invention is directed to removal of condensate liquid and vapors from a conventional air conditioning system employed in a habitable structure or enclosure and more particularly to a system of removing toxic fumes from a home, office, or the like by means of a conventional air conditioning system, the air circulation of which is substantially closed to the atmosphere.

It has been found that working in an office with an energy efficient heating, ventilating and air conditioning system can be hazardous to the health. Particularly those systems which are a product of the energy crisis of the 1970's.

Rising costs of energy focused attention on heating and cooling of newly constructed buildings. About one third of the cost of operating a building goes toward heating or cooling the air inside and moving it around.

Standard practice in the past had been to exhaust some of the interior air and replace it in the system with fresh atmospheric air from outside of the building which is heated or cooled. It was found that heating and cooling bills could be reduced by only recirculating air within a building, leaving less atmospheric air to be treated and added to the system.

This modernized energy efficient concept produces many sources of irritation to people within the buildings. In new buildings likely sources of indoor air pollution are chemical, and include the materials from which a modern office is constructed and furnished. Formaldehyde fumes escape from furniture, upholstery, wood paneling, drapery or carpet fabrics. Solvents and adhesives emit fumes. Copying machines and other photochemical reactions produce ozone. Occupants produce carbon dioxide and water vapor.

In older buildings offices produce dust, mildew, old tobacco smoke, flaking paint and asbestos insulation, flooring or roofing materials, and as in new buildings as well micro-organisms from people, animals and plants.

Any new air which enters old or new buildings contain traces of all sorts of environmental toxic vapors such as, for example commercial solvents, acid, undesirable odors and the like.

In general all air conditioning systems collect and drain condensate from the evaporator or "A" frame unit from damp circulating air through a conventional "P" trap drain system. The use of such a "P" trap drain system is taught by U.S. Pat. Nos. 3,131,548; 3,691,786 and 4,280,334.

The condensate from the air conditioning systems is a result of removing moisture from the damp circulating ambient air as it passes the reduced temperature evaporator. This condensate also includes a concentration of contaminates removed from the circulating air. Vapor contaminates are collected and concentrated around or near the evaporator as a result of reduced evaporator temperature. In the present air conditioning systems this concentrated vapor is ignored and allowed to return to the circulating air of the system. The above mentioned U.S. Pat. No. 3,691,786 further increases the contaminate vapor released into the circulating airstream by elevating the temperature of the condensate which is contained with the drip tray as a means of cooling the refrigerant exiting the evaporator. Condensate in excess of a given pan level is drained from the systems in a conventional manner through a "P" trap. Although some of the condensate vapor from the heated condensate liquid exits to atmosphere a considerable amount is returned to the circulating airstream. Further there is no teaching in this reference as to mold, etc. in the condensate tray as the moisture therein begins to evaporate while the air conditioning system is inoperative.

Until the emergence of the instant invention there has not been a successful method of removing substantially all of the contaminates from the treated air of building air conditioning systems.

SUMMARY OF THE INVENTION

This invention is directed to a novel means for removing substantially all of the vapor and liquid contaminates and the contaminates that they contain from circulating air conditioned air.

In a conventional building air conditioning system in which the building air is continually circulated and very little ambient air is added to the system the vapor and liquid condensate from a conventional "A" frame evaporator of a reduced temperatures is immediately removed from the circulating air stream. A pressure differential between the vapors around the evaporator and condensate liquid collection pan and ambient air causes the vapors to be forced from around the evaporator and liquid condensate collection pan to atmosphere through a vent attached to the lowest elevation of the collection pan and elevated to a vertical level above the evaporator and collection pan. The liquid is continually removed by gravity in a conventional manner from the pan. Any vapor emitted from the liquid trapped in the "P" trap will also be forced from the system through the vent.

In one embodiment of the invention, a blower fan is positioned between the collection pan and "P" trap and the vent to the atmosphere. The fan can be operated selectively to remove vapors or can be used in conjunction with the operating air conditioning system to increase the pressure differential between the pan, "P" trap and atmosphere for enhanced contaminate vapor removal. The fan may also be used to dry the collection pan after each air conditioning use cycle.

The main objects of this invention is to remove contaminate vapors from ambient air of closed circulating air conditioning systems.

Another object of this invention is to provide a means for removing contaminate vapors from non-operating air conditioning systems.

Still another object of this invention is to remove the contaminate vapors from the "P" trap of the liquid drain of air conditioning systems.

Still a further object is to speed the drying of moisture in the collection pan after each air conditioning use cycle.

Further objects, features and advantages of this invention will become apparent from consideration of the following description, the appended claims and the accompanying drawings in which:

BRIEF DESCRIPTION OF THE DRAWINGS FIGURES

DESCRIPTION OF THE PREFERRED EMBODIMENT

Figure 1:
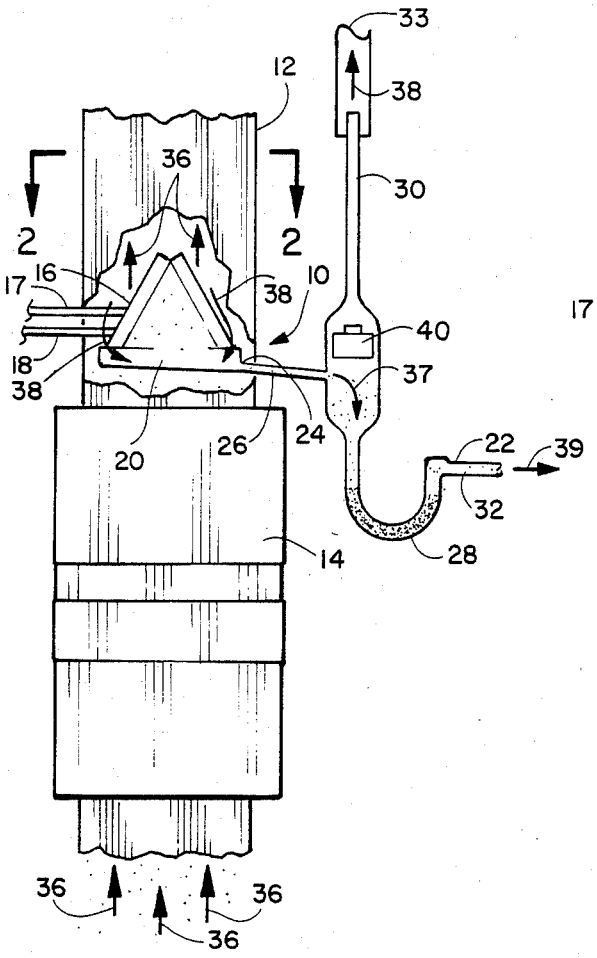
FIG. 1 is a side schematic showing in elevation of the present invention.
Figure 2:
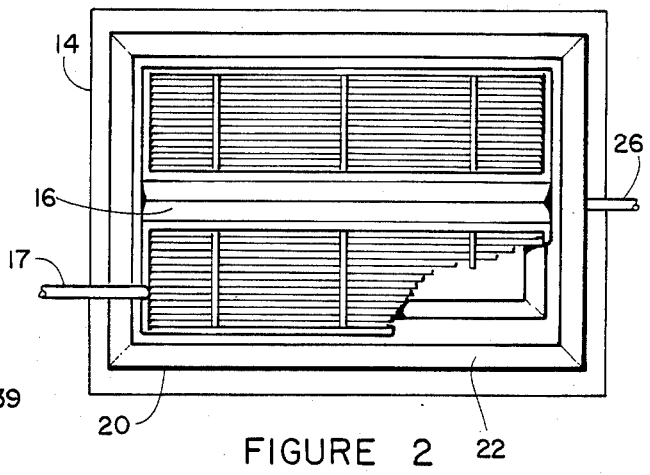
FIG. 2 is a top plan view taken along line 2—2 of FIG. 1.
Figure 3:
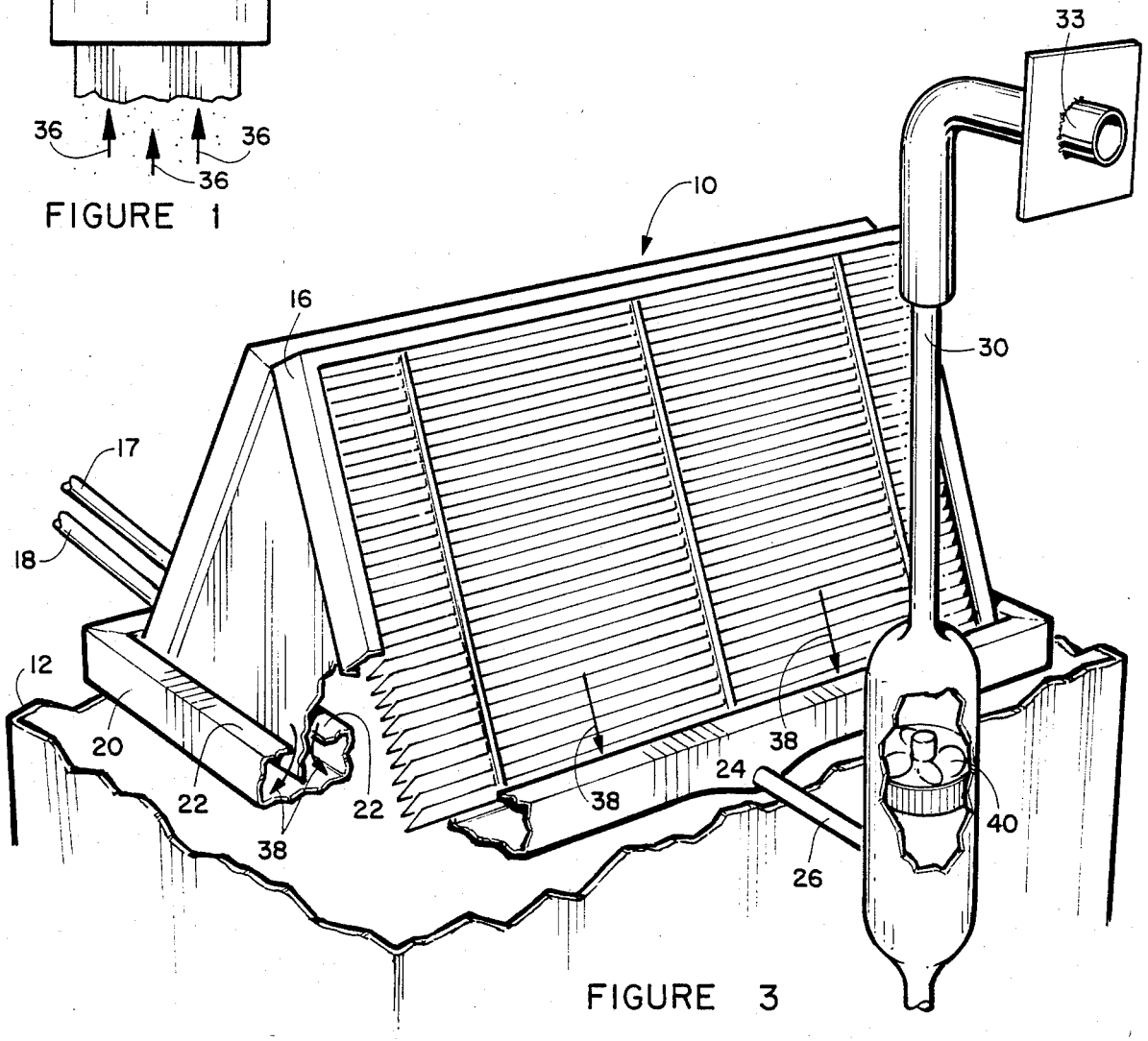
FIG. 3 is a perspective showing in elevation of the present invention adapted to a conventional air conditioning system.

Referring now to the drawing Figures, FIGS. 1 and 3 depict a portion of a conventional air conditioning system 10 including the vapor and liquid contamination removal system.

An air circulating duct 12 houses, conventional air conditioning blower 14 and an "A" frame evaporator coil 16 of the system. Conduits 17 and 18 respectively supply and remove refrigeration liquid from the "A" frame evaporator. A collection pan 20 is positioned beneath and around the bottom surface of the "A" frame evaporator. The pan 20 includes a lip 22 which surrounds and supports the "A" frame evaporator relative to the pan. This lip 22 is positioned closely to the outer surface of the "A" frame evaporator so as to allow the liquid condensate from the evaporator as well as the vapor from around the evaporator to pass freely into the collection pan.

The collection pan is tilted toward one corner 24. Connected at this low point is conduit 26 which leads to "P" trap 28 and to vent 30 the open end of which is vertically elevated above the level of the "A" frame evaporator and collection pan. The opposite end of the "P" trap 22 is connected to a conventional sewer line (not shown) through conduit 32. The opposite ends 33 of the vent exists to the atmosphere external of the building or enclosure.

In operating, the air conditioning blower 14 circulates damp air from occupied space under pressure past the "A" frame evaporator coil 16 along arrows 36. The damp air is cooled by the evaporator and returned to the occupied space from which it originated.

The "A" frame evaporator's surface temperature is approximately 40° Fahrenheit which is below the dew point of the moisture carried in the passing airstream. This causes the dampness from the air including some contaminates carried in the air to form droplets and concentrated vapor which flows along arrow 37 into the collection pan 20 and into "P" trap 28 and out conduct 32 along arrow 39 by gravity. As the condensate flows its temperature increases producing vapors which also include contaminates from the occupied space. These vapors are forced along arrows 38 because of the positive pressure at the "A" frame evaporator area and condensate pan relative to the ambient air at the exterior end of the vent 33. Any vapors emitted from the fluid contained in the "P" trap will likewise be forced out and into the atmosphere through end 33.

If excessive vapor is formed or it is desirable to provide a positive pressure when the blower 14 is inoperative when the air conditioning system is off, a vent blower fan 40 such as a muffin fan can be installed in the vent 30. During normal operation of the air conditioning blower 14, the operating vent blower fan 40 will increase the pressure differential for vapor exit acceleration and when the blower is inoperative with air conditioning system shut down vapors will be continually removed from the "A" frame evaporator area condensate pan and the "P" trap to substantially prevent the vapors from reentry into the occupied area air.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. Apparatus for removing gaseous contaminates from enclosed occupied space comprising:

a central air conditioning system comprising an evaporator having a base and an outer surface temperature below ambient temperature, said evaporator is housed within a duct member through which damp ambient air under positive pressure is circulated from said occupied space through said central air conditioning system when said central air conditioning system is operating, said air from said occupied space flows through said duct member, across the outer surface of said evaporator whereby the temperature of the air is reduced and at least a portion of dampness is removed in the form of condensate and the drier cooled air is then returned to said occupied space;

a condensate collector positioned around said base of said evaporator for collecting condensate therefrom, the collected condensate is caused to flow to a central opening in said condensate collector;

a drain means interconnected at one end to said central opening in said condensate collector, the opposite end of said drain means is connected to a liquid discharge means for draining the liquid condensate from said condensate collector by gravity means;

a vent means open at one end to the atmosphere external of said duct member and occupied space, the other end of which is connected to said drain means intermediate said central opening in said condensate collector and said liquid discharge means; and means for forcing a portion of said air from said occupied space to flow across the surface of said condensate collector, into said central opening, through the drain means and out said vent means to the atmosphere thereby removing gaseous contaminates therewith.

2. The invention as defined in claim 1 wherein the outer surfaces of said evaporator are closely spaced to the upper surfaces of said condensate collector allowing air under pressure and liquid condensate to flow therebetween and the bottom surface area of said condensate collector adjacent to said central opening is at a lower vertical elevation than the rest of said condensate collector.

3. The invention as defined in claim 1 wherein said means for forcing a portion of said air from said occupied space through said vent is a fan blower means positioned intermediate the vent connection to said drain means and the end of said vent means open to the atmosphere.

4. The invention as defined in claim 1 wherein said means for forcing a portion of said air from said occupied space is the pressure of said damp ambient air under positive pressure.

5. The invention as defined in claim 1 wherein means is provided to cause air flow across the surface of said evaporator and condensate collector when said central air conditioning system is inoperative.

* * * * *